US006210069B1

(12) United States Patent
Speck

(10) Patent No.: US 6,210,069 B1
(45) Date of Patent: Apr. 3, 2001

(54) SUPPORT BLOCK FOR USE IN INTERCONNECTING STORAGE CRATES, AND METHOD OF USING SAME

(76) Inventor: John W. Speck, 37748 Meadow Hill, Farmington Hills, MI (US) 48167

( * ) Notice: Subject to any disclaimer, the term of this patent is extended or adjusted under 35 U.S.C. 154(b) by 0 days.

(21) Appl. No.: 09/066,872

(22) Filed: Apr. 27, 1998

(51) Int. Cl.[7] ..... B61D 45/00

(52) U.S. Cl. ..... 403/408.1; 403/388; 410/82

(58) Field of Search ..... 403/408.1, 388, 403/384, 292, 294; 410/82, 80, 78; 24/287; 220/693, 23.4

(56) References Cited

U.S. PATENT DOCUMENTS

| | | | | |
|---|---|---|---|---|
| 3,599,824 | | 8/1971 | Pneuman . | |
| 4,196,673 | * | 4/1980 | Looks | 24/287 X |
| 4,577,448 | * | 3/1986 | Howorth | 403/408.1 X |
| 4,602,760 | * | 7/1986 | Tiefenbach et al. | 403/408.1 X |
| 4,636,105 | * | 1/1987 | Johansson | 403/292 X |
| 4,716,015 | * | 12/1987 | Carlson | 403/388 X |
| 4,732,519 | * | 3/1988 | Wagner | 403/408.1 X |
| 4,784,510 | | 11/1988 | Messori . | |
| 4,856,150 | * | 8/1989 | Johnson | 24/287 |
| 4,942,975 | | 7/1990 | Capron . | |
| 4,948,315 | | 8/1990 | Limberis . | |
| 4,993,125 | | 2/1991 | Capron . | |
| 5,135,247 | | 8/1992 | Alfaro . | |
| 5,199,589 | | 4/1993 | Noble . | |
| 5,433,550 | | 7/1995 | Huber . | |
| 5,449,081 | | 9/1995 | Sjostedt . | |
| 5,454,673 | | 10/1995 | DiMartino . | |
| 5,807,012 | * | 9/1998 | Emmert et al. | 403/408.1 X |

* cited by examiner

*Primary Examiner*—Lynne H. Browne
*Assistant Examiner*—John R. Cottingham
(74) *Attorney, Agent, or Firm*—Carrier Blackman & Associates, P.C.; Joseph P. Carrier; William D. Blackman

(57) ABSTRACT

An improved method and apparatus for interconnecting a plurality of storage containers of a type having rectangularly shaped recesses formed therein. In one embodiment hereof, the present invention provides a support block which includes four integral side walls which are connected to one another to define a substantially rectangular block shape. The side walls of the block are preferably made to taper, so as to be progressively thinner as they extend further away from a center line which bisects the block. The block also includes a support boss, which is located in between all four side walls and which is connected to at least two side walls. The support boss is connected to the walls of the block by an integral connector, which may take different forms. The support boss has a central bore formed therethrough to receive and support a shaft of a fastener therein. The central bore in the support boss may be also be made to taper, in order to facilitate alignment of the block with a threaded fastener which may be passed therethrough. In a method of interconnecting storage crates according to the present invention, a section of wall is removed from one side of a first crate, and a section of wall is also removed from one side of a second crate. Then, holes are drilled through the first and second crates, at the back of recesses formed at the bottom of the open walls thereof. The first and second crates are then aligned so that the drilled holes line up. Support blocks, in accordance with the present invention, are placed into recesses in between the first and second crates, adjacent the drilled holes thereof. A fastener, such as a bolt or threaded rod, is also placed through the central bore of each support block used, and through the drilled holes of the crates. At least one end of the fastener extends past an inner surface of a crate wall. Then, a corresponding fastener is placed on the end of the rod which extends past the inner crate surface.

15 Claims, 3 Drawing Sheets

SUPPORT BLOCK FOR USE IN INTERCONNECTING STORAGE CRATES, AND METHOD OF USING SAME

BACKGROUND OF THE INVENTION

1. Field of the Invention

The present invention relates to a support block for use in interconnecting storage crates, and to a method of using the support block to interconnect such crates. More particularly, the present invention relates to a support block having a hollow bore formed therethrough, and to a method of using the support block, in cooperation with fasteners, to interconnect storage crates. In particular, the block hereof is useful with crates of a type having recesses formed therein.

2. Background Art

Storage crates of relatively large capacity are widely used in industrial settings. A commonly used type of large plastic storage crate, which is foldably collapsible when not in use, is commercially available from the Ropak Corporation of Georgetown, Ky. Many other types of storage crates are commercially available. Sometimes, a particular storage crate does not have adequate capacity for a specific application thereof, and a user may wish to connect two or more storage crates together, to form a larger capacity crate assembly.

Various devices and methods have been advanced for connecting storage crates together. Methods and equipment for connecting containers together are discussed in U.S. Pat. Nos. 3,599,824, 4,108,326, 4,728,234, 4,819,820, 4,942,975, 4,993,125, 5,199,589, and 5,454,673. Several of the known devices, for interconnecting crates or other containers, are somewhat complicated and cumbersome. While numerous devices are known and available for interconnecting containers of various types, a need still exists for an improved method and apparatus for interconnecting storage containers. In particular, a need exists for equipment to durably and reliably interconnect storage crates of a type having recesses formed therein. Ideally, an apparatus for use in interconnecting containers would be reliable, easy to manufacture, relatively inexpensive, and somewhat forgiving if two containers were not initially in perfect alignment.

SUMMARY OF THE INVENTION

The present invention provides an improved method and apparatus for interconnecting a plurality of storage containers. The method and apparatus hereof is intended to be used with storage containers of a type having rectangularly shaped recesses formed therein, that is, recesses having a square or rectangular outline.

In one embodiment hereof, the present invention provides a support block for use in interconnecting storage crates of a type which have recesses formed therein.

A support block in accordance with the present invention, generally, includes four integral side walls which are connected to one another to define a substantially rectangular block shape, and a support boss which is located in between all four side walls and which is connected to at least two of the side walls, the support boss having a central bore formed therethrough to receive and support a shaft of a fastener therein.

In a preferred embodiment of the support block according to the present invention, the support boss is connected to the walls of the block by a partition plate which contacts at least two of the side walls and which is substantially perpendicular thereto, the partition plate being integrally formed with the side walls and having a central hole formed therethrough which is coextensive with the central bore of the support boss.

Another feature of the preferred support block hereof is that each of the side walls has a center line located midway between opposed edges thereof, wherein the center lines of all four walls lie in a common plane. Further, in this preferred embodiment, each of the side walls is thickest at the center line thereof, and tapers so as to be progressively thinner as it extends further away from the center line.

An optional feature of the preferred support block according to the present invention is that the central bore in the support boss may be made to taper from a maximum diameter section at a first end thereof, to a minimum diameter section at a second end thereof. This is done to facilitate alignment of the block with a threaded fastener which may be passed through the bore of the support boss, and/or with a drilled hole at the back of a recess in a crate wall.

As noted, the present invention also encompasses a method of using the support block hereof to interconnect two storage crates. A method of interconnecting storage crates according to the present invention, generally, begins with a step of removing a section of wall from one side of a first crate, and removing a section of wall from one side of a second crate.

Another step, in the method according to the present invention, is drilling holes through the first and second crates. These holes are drilled at the back of recesses formed in the crate walls that have had sections removed therefrom.

Another step in the method hereof is aligning the first and second crates so that the drilled holes line up, and placing support blocks, in accordance with the present invention, in between the first and second crates adjacent the drilled holes thereof, with fastening members placed through the bores of the support blocks. The crates are pushed together so that the blocks fit into aligned recesses in both crates to strengthen the joint therebetween.

The next step in the method hereof is inserting a cooperating fastener, such as a nut, on an end of fastening members which extend past an inner surface of a crate wall to lock the two crates together.

For a more complete understanding of the present invention, the reader is referred to the following detailed description section, which should be read in accordance with the accompanying drawings. Throughout the following description, like numbers refer to like parts.

DETAILED DESCRIPTION

I. Support Block

Figure 4:
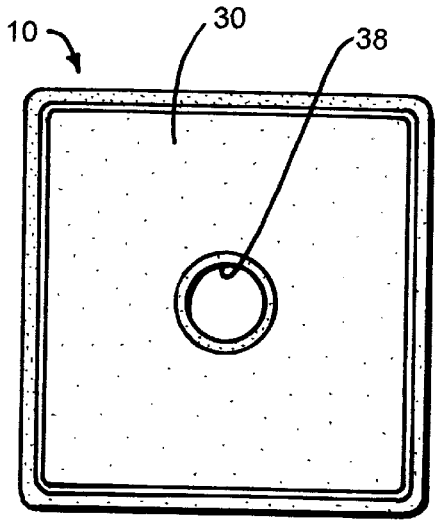
FIG. 4 is a rear plan view of the support block of FIGS. 1–3.
Figure 5:
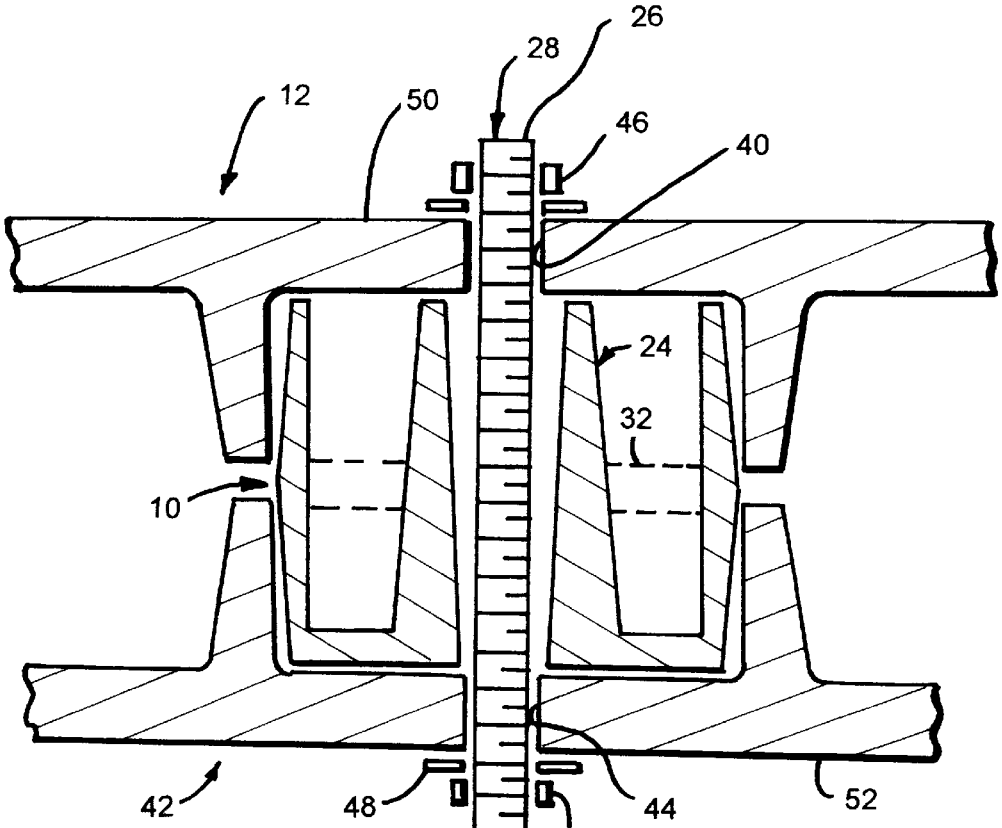
FIG. 5 is a cross-sectional view of the support block of the present invention in place in between two storage crates, the storage crates being joined together by fastening members.
Figure 6:
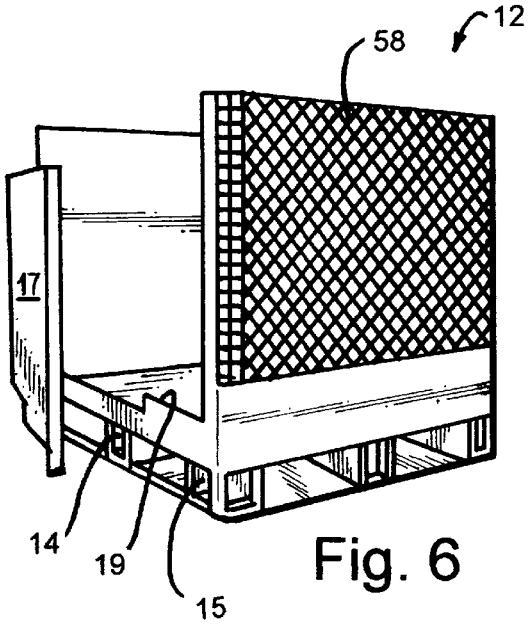
FIG. 6 is a perspective view of a storage crate of a type which is usable with the block according to the present invention.

Referring now to FIGS. 1–6 of the drawings, a support block, in accordance with a preferred embodiment of the present invention, is shown generally at 10. The support block 10 is advantageous for use, in conjunction with fastening members as will be further described herein, in a method of interconnecting storage crates such as that shown at 12 (FIG. 6). Preferably, storage crates to be joined together, using the method and apparatus hereof, are of a type which have recesses such as those shown at 14, 15 formed therein. The block 10 will fit into recesses 14, 15 which have substantially flat upper and lower internal surfaces. In the practice of the present invention, it is preferred, but not required, that the block 10 be formed as an integral unit. Preferably, the block 10 is formed from a strong plastic, but other materials such as aluminum, die cast metal, etc. may be used to form the block. One suitable plastic material for use in forming the block 10 hereof is sold by GE plastics under the trademark XENOY.

Figure 1:
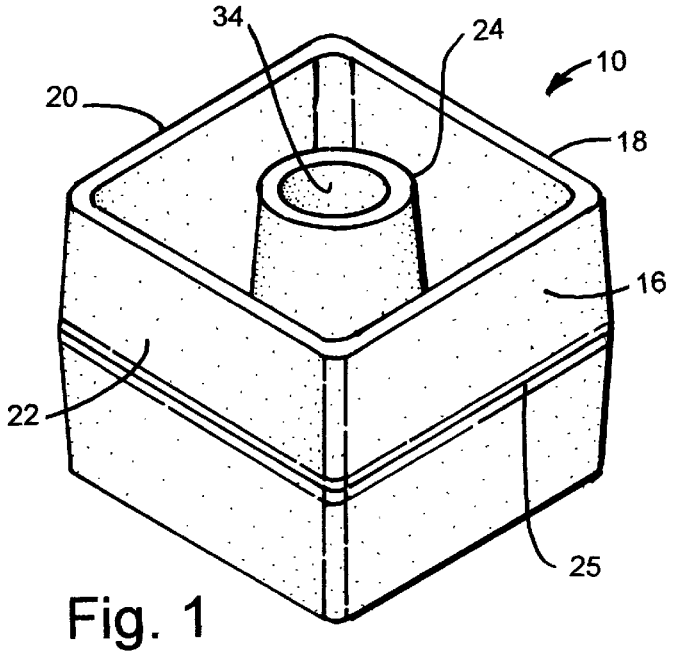
FIG. 1 is a perspective view of a support block in accordance with a first embodiment of the present invention.
Figure 2:
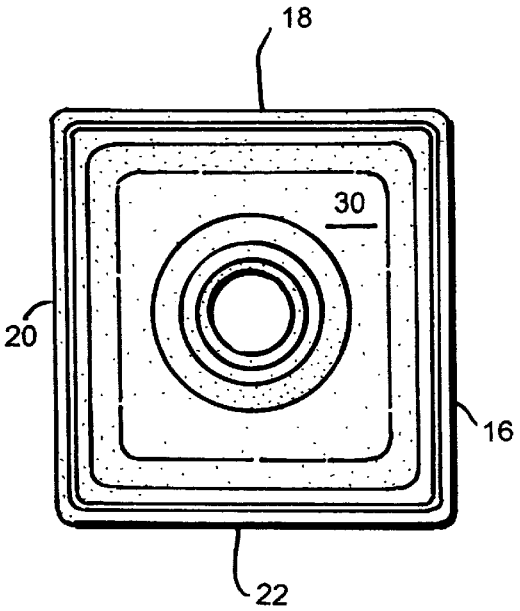
FIG. 2 is a front plan view of the support block of FIG. 1.
Figure 3:
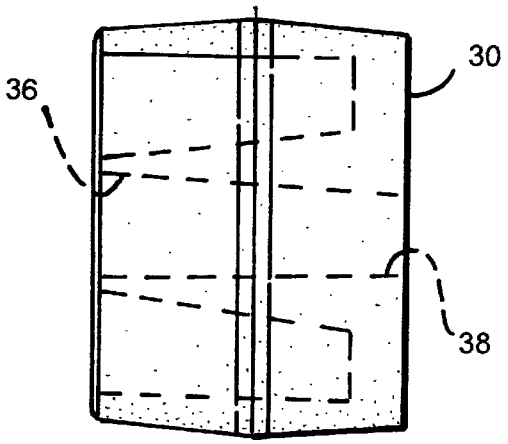
FIG. 3 is a side plan view of the support block of FIGS. 1–2, with the interior of the block shown in phantom.

The block 10 is approximately cube-shaped, with four integral side walls 16, 18, 20, and 22, which are connected to one another at right angles, as shown in FIG. 2, to define a substantially rectangular block or cube shape. Each of the walls 18, 20, 22, 24 is bisected by a center line 25, the center line lying along a plane which is common to all four walls and which bisects the block 10. As seen in FIGS. 3 and 5, the block 10 is thickest or widest at the center line 25, and narrows as it moves away therefrom. The block 10 is made tapered in this way to make it somewhat self-aligning, and easy to insert into a recess 14 in a storage crate 12.

The block 10 also includes a support boss 24, which is centrally located in between all four side walls. The support boss 24 is provided for receiving and supporting a cylindrical shaft 26 of a fastener 28 therein. In the depicted embodiment 10, the support boss 24 is shown as being substantially cylindrical, although it may be made in any cross-sectional shape. The support boss 24 is attached to the walls 16, 18, 20, 22 by a partition plate 30 which is transverse to the walls and which forms a fifth side of the block 10, as shown in FIGS. 3 and 4.

Alternatively, the partition plate may be located across the center of the block 10, as shown in phantom at 32 in FIG. 5. In either case, the partition plate 30 or 32 fixedly connects the support boss 24 to the walls 16, 18, 20, 22. It is preferred that the partition plate contact at least two of the side walls so as to interconnect the support boss 24 thereto. Optionally, the partition plate may have gaps or holes (not shown) formed therein, but the use of either a solid continuous partition plate 30 or 32, or multiple radial fin design is, however, preferred for strength and reinforcement.

Figure 2A:
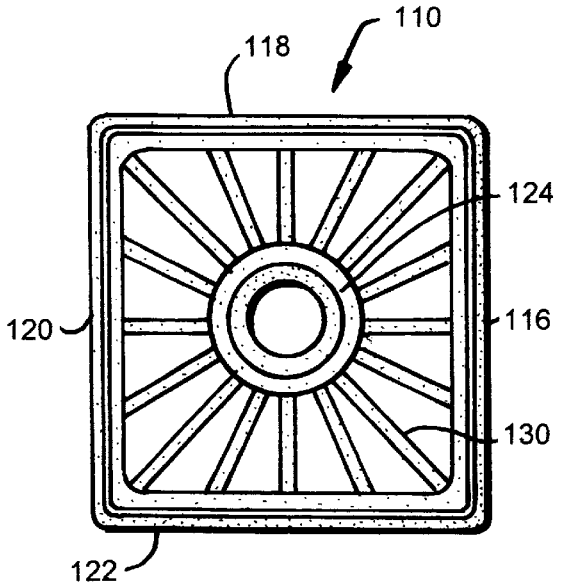
FIG. 2A is a front plan view of an alternate embodiment of a support block in accordance with the present invention.

Another alternative means of connecting the support boss to the walls is shown in FIG. 2A. In this embodiment of the block 110, four walls 116, 118, 120, 122 are substantially identical to the walls 16, 18, 20, 22 as previously described, and a support boss 124 is centrally located and is substantially identical to the support boss 24 of the block 10 in the first embodiment, but here, instead of using a partition plate, the support boss and walls are interconnected by a plurality of radially oriented fins 130. Where used, it is preferred that these fins 130 extend the full length of the block 110.

The support boss 24 has a central bore 34 formed therethrough to receive and support a shaft 26 of a fastener 28 therein, as noted. In the preferred design of the block 10, the bore 34 in the support boss tapers from a maximum diameter section at a first end 36 thereof, to a minimum diameter section at a second end 38 thereof. The bore is tapered to make it easier to line up the first end 36 thereof with a hole 40 (FIG. 5) in a crate.

II. Method of Use

Referring now to FIGS. 5–8, a series of steps in assembling two crates 12, 42 into a single large crate 55 (FIG. 8), using the support block according to the present invention, are shown. The crates 12, 42 are substantially identical to one another. A first crate 12 is shown in FIG. 6. The crate shown in FIG. 6 is based on products which are made and sold by the Ropak Corporation of Georgetown, Ky. Crates of other types and designs may be used with the support block 10 according to the present invention, but it is necessary that crates to be joined together by the method of the present invention have recesses such as those shown at 14, 15 formed therein, and that the recesses have substantially flattened top and bottom surfaces.

In joining two crates together according to the method of the present invention, a section of wall 17 is removed from one side of a first crate 12, and a section of wall is also removed from one side of a second crate 42 which is substantially identical to the first crate. Where using ROPAK crates, a wall section 17 may be removed from a crate simply by removing a hinge pin which connects the wall section to the base 19 of the crate 12. Some trimming of the base 19 may be required in preparation for joining the two crates 12, 42.

Figure 7:
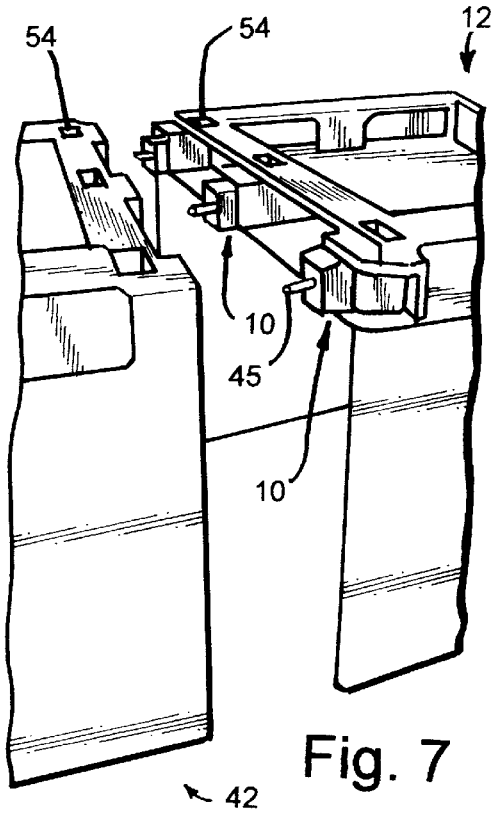
FIG. 7 is a cutaway perspective view of two inverted storage crates, similar to the single crate of FIG. 6, which are being positioned for joining together according to the present invention to form a single large storage crate.
Figure 8:
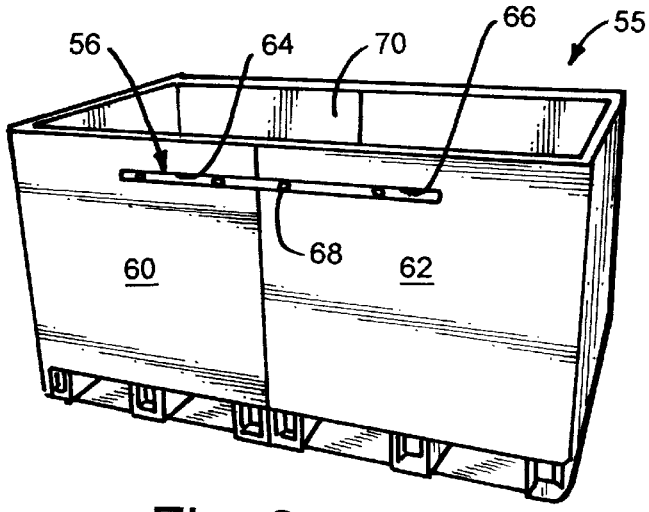
FIG. 8 is a single large storage crate formed out of two smaller crates, using the support blocks and method according to the present invention.

Then, the crates may, optionally, be inverted so as to make the recesses 14, 15 easier to work on, and holes such as that shown at 40 and 44 (FIG. 5) are drilled through the first and second crates 12, 42, at the back of recesses formed at the bottom of the open walls thereof. The first and second crates 12, 42, are then aligned as shown in FIG. 7 so that the drilled holes 40, 44 line up with one another, and so that the open walls thereof face one another.

A plurality of support blocks 10, in accordance with the present invention, are then placed into the recesses in between the first and second crates, adjacent the drilled holes thereof. A fastener 28, such as a bolt or threaded rod 45, is also placed through the central bore 34 of each support block used, and also through the drilled holes 40, 44 of the crates 12, 42. Preferably, in the practice of the present invention, a threaded rod 45 is placed through the bore 34 of each support block 10 used, and then the support blocks 10, with the rods 45 installed therein, are placed into the recesses 14, 15 of one of the crates 12 as shown in FIG. 7, with the threaded rods 45 extending through holes 40 formed in the backs of the recesses. Then, the crates 12, 42 are pushed together in abutting relationship so that the threaded rods 45 also extend through the holes 44 formed in the second crate 42. Where bolts (not shown) are used, at least one end thereof extends past an inner surface 50 of a crate wall.

Then, a washer 48 and a nut 46, or other fastener is placed on each end of each rod 45 which extends past an inner crate surface 50, 52. Access holes 54 are provided in the crate bottom surfaces so that a wrench may be inserted to tighten the nuts 46 in place. Preferably, locking nuts such as those sold under the trademark NYLOX are used so as to avoid unplanned loosening thereof. The finished product is a single, large crate such as the crate assembly 55 shown in FIG. 8.

Side Rails

Optionally, in the practice of the method according to the present invention, added reinforcements in the form of side rails 56 are used in forming the crate assembly 44. The material used for the side rails may be, e.g., ¼" steel bar stock or, most preferably, may hollow square tubing because of its superior strength. As shown in FIG. 6, ROPAK containers normally have a hollow gridwork 58 on the sides thereof for strength and reinforcement. Where side rails 56 are going to be installed to join side wall sections 60, 62 of the crate assembly together, a router may be used to cut material away from the gridwork 58 to form slots 64, 66 in the wall sections. Then, holes are drilled through the wall sections 60, 62 at the slots 64, 66 and corresponding holes are drilled through the side rails 56. Suitable fasteners, such as nuts and bolts 68, are then used to fasten the side rails 56 to the crate assembly 44. In the preferred practice of the present invention, the fastener surfaces inside the crate assembly 44 are either countersunk to be recessed or flush with the inner crate surface 70, or are partially recessed and then trimmed to be flush with the surface 70.

Although the present invention has been described herein with respect to preferred embodiments thereof, the foregoing description is intended to be illustrative, and not restrictive. Many modifications may be made to the described embodiments without departing from the scope hereof. All such modifications, which fall within the scope of the appended claims, are intended to be within the scope and spirit of the present invention.

What is claimed is:

1. A free standing support block interconnecting storage crates which have recesses formed therein, the block comprising:

four integral side walls which are connected together to define a rigid block shape; and a support boss which is located centrally between all four side walls and which is connected to at least two of the side walls, the support boss having a central bore formed therethrough to receive and support a workpiece therein;

wherein the support block is constructed and arranged such that the central bore of the support boss provides a substantially unobstructed passage therethrough, whereby a workpiece may be passed through the block and extend outwardly from two opposed exterior surfaces thereof; and the central bore is tapered such that it has a larger diameter at one end thereof and tapers to a smaller diameter from said one end for facilitating insertion of the workpiece into the one end.

2. The support block of claim 1, wherein each of the side walls has a center line located midway between opposed edges thereof, wherein the center lines of all four walls lie in a common plane, and further wherein each of the side walls is thickest at the center line thereof, and tapers so as to be progressively thinner as the side wall extends further away from the center line.

3. A free standing support block interconnecting storage crates which have recesses formed therein, the block comprising:

four integral side walls which are connected together to define a rigid block shape;

a partition plate which contacts at least two of the side walls and which is substantially perpendicular thereto, the partition plate being integrally formed with the side walls and having a central hole formed therethrough; and a support boss which is located between all four side walls and which is attached to the partition plate, the support boss having a central bore formed therethrough to receive and support a shaft of a fastener therein;

wherein the support boss is aligned with the partition plate in a manner such that the support boss central bore coincides with, and communicates with the central hole in the partition plate, and further wherein support block is constructed and arranged such that the central bore of the support boss provides a substantially unobstructed passage through the support block and includes open ends which communicate with space outside the block, whereby a fastener shaft may be passed through the block and extend outwardly from two opposed exterior surfaces thereof; and the central bore is tapered such that it has a larger diameter at one end thereof and tapers to a smaller diameter away from said one end for facilitating insertion of a fastener shaft into said one end.

4. The support block of claim 3, wherein each of the side walls has a center line located midway between opposed edges thereof the center lines of all four walls, wherein the center lines of all four walls lie in a common plane, and further wherein each of the side walls is thickest at the center line thereof, and tapers so as to be progressively thinner as the side wall extends further away from the center line.

5. The support block of claim 3, wherein the partition plate is located at an edge of each of the side walls, to define an outer surface of the block at an outer surface of the partition plate, and wherein the support boss terminates at its connection with the partition plate, and does not extend outwardly from the block further than the outer surface defined by the partition plate.

6. The support block of claim 1, wherein the support boss is connected to the walls of the block by a partition plate which contacts at least two of the side walls and which is substantially perpendicular thereto, the partition plate being integrally formed with the side walls and having a central hole formed therethrough, wherein the support boss is aligned with the partition plate in a manner such that the support boss central bore coincides with, and communicates with the central hole in the partition plate.

7. The support block of claim 1, wherein the support boss is located substantially surrounding a central axis of the block.

8. The support block of claim 3, wherein the support boss is located substantially surrounding a central axis of the block.

9. The support block of claim 1, wherein the support boss is connected to the side walls by a plurality of fins arranged radially therearound.

10. The support block of claim 1, wherein the block is substantially cube-shaped.

11. The support block of claim 3, wherein the support boss is integrally formed with the partition plate, wherein the partition plate extends between and connects all four of the side walls, and wherein the support boss terminates at its connection with the partition plate.

12. The support block of claim 1, wherein said block shape is substantially rectangular.

13. The support block of claim 3, wherein said block shape is substantially rectangular.

14. The support block of claim 1, wherein opposite ends of the block are adapted to be fitted in opposing recesses of an adjacent pair of the storage crates.

15. The support block of claim 3, wherein opposite ends of the block are adapted to be fitted in opposing recesses of an adjacent pair of the storage crates.

* * * * *